United States Patent [19]

Pätzold et al.

[11] 4,301,242

[45] Nov. 17, 1981

[54] EMULSION MIXTURE FOR COLOR REVERSAL (REFLECTION VIEWING) MATERIAL

[75] Inventors: Walter Pätzold; Karl Czernik, both of Leverkusen, Fed. Rep. of Germany

[73] Assignee: Agfa-Gevaert Aktiengesellschaft, Leverkusen, Fed. Rep. of Germany

[21] Appl. No.: 83,229

[22] Filed: Oct. 10, 1979

Related U.S. Application Data

[63] Continuation of Ser. No. 879,264, Feb. 21, 1978, abandoned.

[30] Foreign Application Priority Data

Feb. 26, 1977 [DE] Fed. Rep. of Germany ..... 2708466

[51] Int. Cl.[3] ..... G03C 1/36

[52] U.S. Cl. ..... 430/569; 430/567; 430/570; 430/606; 430/407

[58] Field of Search ..... 430/567, 569, 570, 606, 430/407

[56] References Cited

U.S. PATENT DOCUMENTS

| | | | |
|---|---|---|---|
| Re. 29,575 | 3/1978 | Illingsworth | 430/567 |
| 2,318,597 | 5/1943 | Davey et al. | 430/571 |
| 2,910,539 | 10/1959 | Maffet | 430/531 |
| 3,367,778 | 2/1968 | Berriman | 430/411 |
| 3,501,305 | 3/1970 | Illingsworth | 430/567 |
| 3,573,054 | 3/1971 | Tinker et al. | 430/394 |
| 3,576,636 | 4/1971 | Matsui et al. | 430/547 |
| 3,867,149 | 2/1975 | Furuya et al. | 430/606 |
| 3,989,527 | 11/1976 | Locker | 430/567 |
| 4,023,972 | 5/1977 | Vanassche et al. | 430/569 X |
| 4,035,185 | 7/1977 | Evans et al. | 430/569 X |

*Primary Examiner*—Won H. Louie, Jr.
*Attorney, Agent, or Firm*—Connolly and Hutz

[57] ABSTRACT

An improved photographic material is provided comprising a mixture of individual emulsions having the same narrow particle size distribution but which are desensitized in a differring degree.

2 Claims, 2 Drawing Figures

EMULSION MIXTURE FOR COLOR REVERSAL (REFLECTION VIEWING) MATERIAL

CROSS REFERENCE

Figure 1:
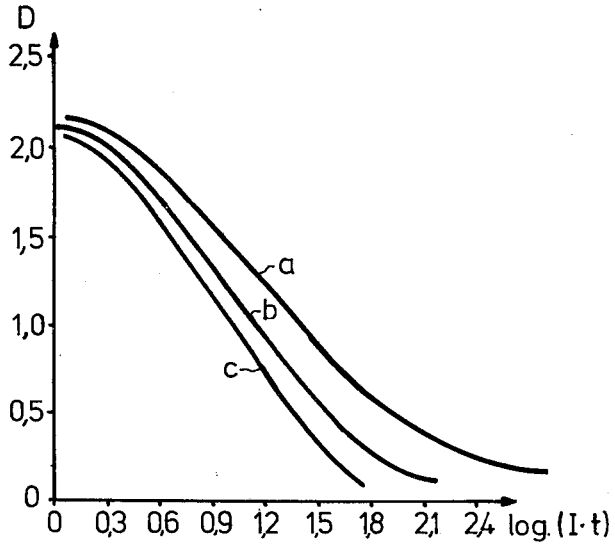

This application is a continuation of the copending U.S. application Ser. No. 879,264 filed Feb. 21, 1978 for Emulsion Mixture for Colour Reversal (Reflection Viewing) Material, now abandoned.

This invention relates to a process for the preparation of photographic silver halide emulsions. It relates in particular to a process for the preparation of emulsions for colour reversal (reflection viewing) material in which fluctuations in the photographic process do not cause deviations from the typical course of the gradation curve.

Reversal materials shoud preferably be constituted so that their gradation curves have a wide linear range combined with high viewing density under reflected light or transmitted light. It is known to use, for this purpose, emulsions which have a soft gradation and very broad range of distribution of particle sizes or mixtures of emulsions which each have a very narrow range of particle sizes but each emulsion having a different particle size.

It is also known to use such developers as a first developer in the photographic process for reversal materials which contain silver halide solvents, particularly thiocyanates.

Advantageous effects are thereby achieved, particularly the following:

1. High sensitivity with low graininess
2. Low minimum densities so that the white is free from a colour tinge, and
3. A more powerful quality-improving interimage effect.

One disadvantage of the known emulsion mixtures which have silver grains of different sizes is that, in the first development with a first developer containing silver halide solvent, the less sensitive areas undergo a stronger physical development because the smaller silver halide grains are more powerfully attacked by the silver halide solvents. Due to this more powerful physical development of the less sensitive areas, deviations from the typical course of the gradation curve occur in response to even slight, virtually unavoidable variations in the photographic process. These variations in the photographic process may be caused by inconstancy of temperature or concentration or by turbulence in one or other of the processing baths or by variations in the residence time of the photographic material in these baths.

It is an object of the present invention to find a process for the preparation of silver halide emulsions for colour reversal materials, by which optimum stability against deviations from the typical course of the gradation curve caused by fluctuations in the photographic process is ensured.

A process has now been found in which silver halide emulsions having the same, narrow particle size distribution are modified in such a manner that, by mixing individual emulsions of this kind, a mixed emulsion is obtained which shows no deviations from the typical course of the gradation curve in response to fluctuations in the photographic process.

The process according to the invention is distinguished by the fact that the individually prepared components of the mixture of emulsions are prepared under substantially identical conditions during precipitation and Ostwald ripening and therefore have the same particle size with the same narrow particle size distribution. One particularly preferred range of particle sizes of the silver halide grains is between 0.3 and 1 μm. In a preferred distribution of particle sizes, 80% of the silver halide grains have a particle size of from 0.4 to 0.6 μm, 10% have a particle size of below 0.4 μm and 10% above 0.6 μm. Furthermore, chemical ripening is carried out under the same conditions in each case so that the sensitivity nuclei in the various individually prepared components of the emulsion mixture are of the same kind and have the same distribution. It is characteristic of the process according to the invention that, up to the end of physical ripening of the individual constituents of the mixture, a certain desensitization is achieved by the addition of known substances to individual components of the mixture. Suitable compounds for this purpose include, bismuth, zinc, rhodium, copper and lead compounds, in particlar rhodium, copper and lead compounds especially $Na_3RhCl_6$, $CuSO_4$, $CuCl_2$ and $Pb(NO_3)_2$.

Although it is already known to add certain metal compounds to photographic silver halide emulsions to sensitize them (R. Koslowsky, Z. Wiss, Phot. 46 (1951), pages 65 to 72), the addition of these compounds is normally carried out at a later stage than in the process according to the invention and does not cause any desensitization but on the contrary sensitizes the silver halide emulsions.

It is also known to add certain metal compounds to photographic emulsions during their preparation, in particular cadmium compounds, in order to improve the contrast properties of photographic emulsions by increasing the gradation. Such an addition of metal compounds differs fundamentally from the process according to the invention in the following respects:

1. The metal compounds are added in much smaller quantities in the process according to the invention (10 to 100 μg per mol of silver nitrate) so that they do not cause a steepening of the gradation but merely a densensitization.

2. A more important difference is that, in the process according to the invention, the metal compounds are not added to all emulsion components of an emulsion layer; on the contrary, the advantage of the process according to the invention rests precisely in the fact that the emulsion layer is built up of individual emulsion components doped with different quantities of the metal compounds used according to the invention.

The materials prepared according to the invention may be developed with the usual colour developer substances, such as N,N-dimethyl-p-phenylene diamine; 4-amino-3-methyl-N-ethyl-N-methoxyethylaniline; monomethyl-p-phenylenediamine; 2amino-5-diethylaminotoluene; N-butyl-N-ω-sulphobutyl-p-phenylenediamine; 2-amino-5-(N-ethyl-N-β-methanesulphonamidoethyl-amino)-toluene; N-ethyl-N-β-hydroxyethyl-p-phenylenediamine; N,N-bis-(β-hydroxyethyl)-p-phenylenediamine and 2-amino-5-(N-ethyl-N-β-hydroxyethylamino)-toluene.

Other suitable colour developers have been described, for example, in J. Amer. Chem. Soc. 73, 3100 (1951).

The photographic material prepared according to the invention may contain the usual colour couplers, which are generally incorporated in the silver halide layers.

The red-sensitive layer, for example, contains a non-diffusible colour coupler for producing the cyan partial image, generally a coupler based on phenol or α-naphthol. The green-sensitive layer contains at least one non-diffusible colour coupler for producing the magenta partial image, usualy a colour coupler based on 5-pyrazolone or indazolone. Lastly, the blue sensitive layer unit contains at least one non-diffusible colour coupler for producing the yellow partial colour image, generally a colour coupler with an open chain keto methylene group. Large numbers of colour couplers of these kinds are known and have been described in numerous Patent Specifications and other publications, for example in the publication "Farbkuppler" by W. Pelz in "Mitteilungen aus den Forschungslaboratorien der Agfa, Leverkusen/München", Volume III (1961) and K. Venkataraman in "The Chemistry of Synthetic Dyes", Vol. 4, 341 to 387 Academic Press 1971.

The non-diffusible colour couplers used may be 2-equivalent couplers. These contain a releasable substituent in the coupling position so that they require only two equivalents of silver halide to form the dye, in contrast to the usual four-equivalent couplers. Suitable two-equivalent couplers include, for example, the known DIR couplers, in which the releasable group is released as a diffusible development inhibitor after the reaction with colour developer oxidation products. So-called white couplers may also be used for improving the properties of the photographic material.

The non-diffusible colour couplers and colour producing compounds are added to the light sensitive silver halide emulsions or other casting solutions by the usual, known methods. If the colour couplers or colour producing compounds are water-soluble, or alkali soluble, compounds, they may be added to the emulsions in the form of aqueous solutions, to which water miscible organic solvents such as ethanol, acetone or dimethylformamide may be added. If the non-diffusible colour couplers and colour producing compounds are insoluble in water or alkalides, they may be emulsified in known manner, e.g. by mixing a solution of these compounds in a low boiling organic solvent directly with the silver halide emulsion or first with an aqueous gelatine solution, the organic solvent being then removed in the usual manner. The resulting emulsion of the given compound in gelatine is then mixed with the silver halide emulsion. In addition, so-called coupler solvents or oil formers may be used for emulsifying such hydrophobic compounds. These coupler solvents or oil formers are generally higher boiling organic compounds which occlude, in the form of oily droplets, the non-diffusible colour couplers and development inhibitor releasing compounds which are required to be emulsified in the silver halide emulsions. Information on this matter may be found, for example, in U.S. Pat. Nos. 2,322,027; 2,533,514; 3,689,271; 3,764,336 and 3,765,897.

The usual silver halide emulsions may be used for the present invention. The silver halide contained in them may be silver chloride, silver bromide, silver iodide or mixtures thereof.

The binder used for the photographic layers is preferably gelatine but this may be partly or completely replaced by other natural or synthetic binders. Suitable natural binders include, for example, alginic acid and its derivatives such as its salts, esters or amides, cellulose derivatives such as carboxymethylcellulose, alkylcelluloses such as hydroxyethylcellulose, starch or its derivatives such as ethers or esters, or carrageenates. Suitable synthetic binders include, for example, polyvinyl alcohol, partially saponified polyvinyl acetate and polyvinyl pyrrolidone.

The emulsions may also be chemically sensitized, e.g. by the addition of sulphur compounds such as allyl isothiocyanate, allyl thiourea and sodium thiosulphate at the chemical ripening stage. Reducing agents may also be used as chemical sensitizers e.g. the tin compounds described in Belgian Patent Specifications No. 493,464 and 568,687, or polyamines such as diethylene triamine or aminomethane sulphinic acid derivatives, e.g. according to Belgian Patent Specification No. 547,323.

Noble metals such as gold, platinum, palladium, iridium, ruthenium or rhodium and compounds of these metals are also suitable chemical sensitizers. This method of chemical sensitization has been described in the article by R. Koslowsky, Z. Wiss. Phot. 46 (1951), 65 to 72.

The emulsions may also be sensitized with polyalkylene oxide derivatives, e.g. with a polyethylene oxide having a molecular weight of between 1000 and 20,000, or with condensation products of alkylene oxides and aliphatic carboxylic acids, aliphatic amines, aliphatic diamines and amides. The condensation products have a molecular weight of at least 700, preferably more than 1000. These sensitizers may, of course, also be combined in order to obtain special effects, as described in Belgian Patent Specification No. 537,278 and British Patent Specification No. 727,982.

The emulsions may also be spectrally sensitized, e.g. with the usual monomethine or polymethine dyes such as acid or basic cyanates, hemicyanines, streptocyanines, merocyanines, oxonoles, hemioxonoles, styryl dyes or others, including trinuclear and higher nuclear methine dyes, for example rhodacyanines or neocyanines. Sensitizers of this kind have been described, for example, in the work by F. M. Hamer "The Cyanine Dyes and Related Compounds" (1964), Interscience Publishers John Wiley and Sons.

The emulsions may contain the usual stabilizers, e.g. homopolar or salt-type compounds of mercury containing aromatic or heterocyclic rings, such as mercaptotriazoles, simple mercury salts, sulphonium mercury double salts and other mercury compounds. Azaindenes are also suitable stabilizers, particularly tetra- or pentaazaindenes and especially those which are substituted with hydroxyl or amino groups. Compounds of this kind have been described in the article by Birr. Z. Wiss. Phot. 47 (1952), 2 to 58. Other suitable stabilizers include heterocyclic mercapto compounds, e.g. phenylmercaptotetrazole, quaternary benzothiazole derivates and benzotriazole.

The emulsions may be hardened in the usual manner, for example with formaldehyde or halogenated aldehydes which contain a carboxyl group, such as mucobromic acid, diketones, methane sulphonic acid esters and dialdehydes.

The photographic layers may also be hardened with epoxide hardeners, heterocyclic ethylene imine hardeners or acryloyl hardeners. Examples of such hardeners have been described, for example, in German Offenlegungsschrift No. 2,263,602 and British Patent Specification No. 1,266,655. The layers may also be hardened by the process according to German Offenlegungsschrift No. 2,218,009, in order to obtain photographic materials which are suitable for high temperature processing.

The photographic layers or colour photographic multilayered materials may also be hardened with diazine, triazine, or 1,2-dihydroquinoline hardeners as described in British Patent Specifications Nos. 1,193,290; 1,251,091; 1,306,544 and 1,266,655, French Patent Specification No. 7,102,716 and German Offenlegungsschrift No. 2,332,317. Examples of such hardeners incude diazine derivatives which have alkylsulphonyl or arylsulphonyl groups, derivatives of hydrogenated diazines or triazines, e.g. 1,3,5-hexahydrotriazine, fluoro-substituted diazine derivatives, e.g. fluoropyrimidines, esters of 2-substituted 1,2-dihydroquinoline- or 1,2-dihydroisoquinoline-N-carboxylic acids. Other suitable hardeners include vinyl sulphonic acid hardeners, carbodiimide and carbamoyl hardeners, e.g. those described in German Offenlegungsschrift Nos. 2,236,602; 2,225,230 and 1,808,685; French Patent Specification No. 1,491,807; German Patent Specification No. 872,153 and DDR Patent Specification No. 7218. Other suitable hardeners have been described, for example, in British Patent Specification No. 1,268,550.

The usual substrates are used, e.g. foils of cellulose nitrate, cellulose acetate, polystyrene, polyesters such as polyethylene terephthalate, polyolefines such as polyethylene or polypropylene, baryta laminated or polyolefine laminated paper substrates, e.g. polyethylene laminated paper substrates and glass.

The advantages of the process according to the invention will now be illustrated with the aid of the following Example but the invention is not limited to this Example.

Example 1 (comparison)

Emulsion mixture known in the art. The following silver halide emulsions I, II and III were prepared separately.

Emulsion I

The reactions are carried out at 63° C. unless otherwise indicated. A solution of 250 g of $AgNO_3$ in 2500 ml of water is added to a solution of 370 g of potassium bromide and 50 g of gelatine in 4000 ml of water. After physical ripening, 100 g of a 10% potassium iodide solution and 1000 ml of water followed by a solution of 250 g of silver nitrate in 2500 ml of water are added. After further physical ripening, 30 ml of a 0.08% $HAuCl_4$ solution and 150 g of gelatine are added to the reaction mixture and the mixture is digested. 50 g of a 0.65% aqueous potassium iodide solution are then added. After 10 minutes physical ripening, the substance is flocculated by the addition of 200 g of a 10% sodium polystyrene sulphonate solution at 22° C. and lowering of the pH to 3.5 with sulphuric acid, and the mixture is decanted. The flocculated emulsion is washed several times at 22° C. and added to a solution of 100 g of a 0.1% sodium thiosulphate solution, 20 g of 25% potassium bromide solution, 10 g of a 25% sodium chloride solution and 550 g of gelatine in 7500 ml of water at 40° C., dissolved by adjustment of the pH to 6.0 and subjected to a controlled after-ripening at 55° C.

Emulsion II

The emulsion is prepared in the same way as Emulsion I except that the various steps of the process are carried out not at 63° C. but at 60° C. and no $HAuCl_4$ is added but 75 g instead of 50 g of the 0.65% potassium iodide solution are added.

Emulsion III

All the steps of the process are carried out at a temperature of 58° C. unless otherwise indicated.

A solution of 250 g of silver nitrate in 2500 ml of water is added to a solution of 370 g of potassium bromide, 60 g of gelatine and 50 g of a 10% potassium iodide solution in 4000 ml of water. After physical ripening, 50 g of a 10% potassim iodide solution and 1000 ml of water are added followed by a solution of 250 g of silver nitrate in 2500 ml of water. 140 g of gelatine are then added and, after further physical ripening, 100 g of a 0.65% aqueous potassium iodide solution. Another physical ripening is then carried out, followed by flocculation of the emulsion as described for Emulsion I.

The individual emulsions I, II and III prepared as described above are mixed in proportions of 70:20:10, the usual emulsion additives are added, and the emulsions are applied to a conventional emulsion substrate so that the emulsion layers obtained have a silver content of from 0.4 to 0.8 g/m$^2$.

The photographic emulsion prepared as described above is then subjected to the following operations:

1. Preliminary washing
2. First development
3. Short stop bath
4. Washing
5. Reversal exposure
6. Colour development
7. Washing
8. Bleach fixing
9. Washing
10. Stabilizing
11. Rinsing.

The developer baths, the bleach fix bath and the stabilizer bath have the following composition:

| | |
|---|---|
| First developer: | |
| Sodium sulphite sicc. | 35 g/l |
| Sodium carbonate sicc. | 25 g/l |
| Sodium borate | 1.5 g/l |
| Hydroquinone | 6 g/l |
| 1-Phenyl-3-pyrazolidone | 0.6 g/l |
| Polyphosphate | 2 g/l |
| Potassium thiocyanate | 1.5 g/l |
| Potassium bromide | 1 g/l |
| pH 10.2 | |
| Colour developer: | |
| Benzyl alcohol | 15 ml/l |
| Ethylene glycol | 3 ml/l |
| Ethylene diamine | 1 ml/l |
| Borax | 30 g/l |
| Sodium sulphite sicc. | 2.5 g/l |
| Hydroxylamine sulphate | 2 g/l |
| 4-Amino-N-ethyl-N(β-methanesulphonamidoethyl)-m-toluidine | 4 g/l |
| Sodium bromide | 0.2 g/l |
| Sodium hydroxide | 6 g/l |
| 1,3-Diamino-2-propanol-tetracetic acid | 1.2 g/l |
| pH 10.5 | |
| Bleach fixing bath | |
| Ammonium thiosulphate | 130 g/l |
| Sodium metabisulphite | 13 g/l |
| Iron-III complex of ethylene diamino-tetracetic acid | 60 g/l |
| Ammonium salt of ethylene diamino-tetracetic acid | 9 g/l |
| Stabilizer bath | |
| Acetic acid | 16 g/l |
| Citric acid | 7 g/l |
| Potassium hydroxide | 1.6 g/l |
| Polyethylene glycol (MW 1300) | 0.6 g/l |
| Stilbene sulphonic acid | 1 g/l |
| pH 3.5. | |

When development is carried out in accordance with the instructions and the development times are accurately observed, a gradation curve similar to curve b of FIG. 1 is obtained. To demonstrate the disadvantageous response of this emulsion to slight fluctuations in processing, FIG. 1 also shows the gradation curves obtained with a slightly shorter development time (a) and with a slighter longer development time (c). FIG. 1 also shows the unavoidable shift in the gradation curve which occurs in response to variations in the development time under otherwise constant conditions; it also shows a pronounced spread in the gradation curves at the threshold region, in other words in the region of relatively high intensity of exposure (relatively low colour densities).

Example 2

The following two individual emulsions are prepared separately.

Emulsion IV

All the steps of the process are carried out at a temperature of 60° C. unless otherwise indicated.

A solution of 250 g of silver nitrate in 2500 ml of water is added to a solution of 370 g of potassium bromide, 50 g of gelatine, 35 g of a 10% potassium iodide solution and 25 g of a solution of $Na_3RhCl_6$ containing 10 ppm thereof and 4000 ml of water. After physical ripening, a solution of 35 g of a 10% potassium iodide solution and 1000 ml of water is added to the reaction mixture, followed by 250 g of silver nitrate in 2500 ml of water. After physical ripening, 30 g of a 0.08% aqueous solution, of $HAuCl_4$ and 150 g of gelatine are added and, after a further physical ripening, 75 g of a 0.65% aqueous potassium iodide solution. After yet another physical ripening, the emulsion is flocculated as described for emulsion I and worked up.

Emulsion V

All the steps of the process are the same as those used for preparing emulsion IV except that no $Na_3RhCl_6$ is added.

Figure 2:
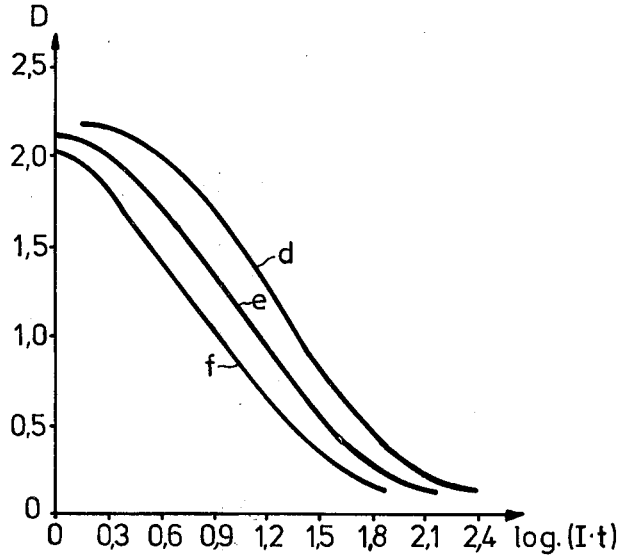

Emulsions IV and V are mixed in proportions of 15:85 and then processed and developed as described in Example 1. FIG. 2 shows the gradation curves obtained when development is carried out: in accordance with Example 1 (e); with a shorter development time (d); and with a longer development time (f). The advantage of the process according to the invention can be seen from a comparison of FIGS. 1 and 2. While the gradation curves in FIG. 1 show a wide spread in the threshold region, such changes do not occur in the process according to the invention represented in FIG. 2.

Apart from these sensitometric advantages, the process according to the invention is distinguished by being more reliable to handle since the individual emulsions can be prepared by identical methods, apart from the addition of the desensitizing metal compounds.

We claim:

1. A process for the preparation of a silver halide emulsion layer for reversal photographic materials comprised of at least two individual emulsions, by (a) precipitation of the silver halide in a protective colloid, (b) physical and chemical ripening including precipitating and ripening separate and individual emulsions under conditions providing particle size distributions of a narrow particle size distribution, and resulting in substantially identical particle sizes and identical size distribution (c) during said preparation process and prior to completion of ripening adding to only one emulsion at least one compound in a desensitizing amount and selected from the group consisting of rhodium, copper and lead compounds, thereby providing in said emulsion a differential in desensitizing and then mixing of the individual emulsions, applying the mixture in the photographic material to a support in a layer, in which material the individual emulsions are desensitized to differing extents by the addition of at least one desensitizing compound to said one emulsion, of said desensitizing compounds whereby the individual emulsions in the applied layer prior to exposure to light contain different desensitization values than the layer has when subjected to variations in development or developer a minimal displacement of contrast gradation curves at the region of relatively high intensity of exposure.

2. Process according to claim 1, characterised in that the desensitizing compounds used are $Na_3RhCl_6$, $CuCl_2$, $CuSO_4$ or $Pb(NO_3)_2$.

* * * * *